US007941870B2

(12) United States Patent
Kingto

(10) Patent No.: US 7,941,870 B2
(45) Date of Patent: May 17, 2011

(54) SYSTEM FOR PLACING DISPOSABLE SWEATBAND

(76) Inventor: Tsai Kingto, Houston, TX (US)

( * ) Notice: Subject to any disclaimer, the term of this patent is extended or adjusted under 35 U.S.C. 154(b) by 0 days.

(21) Appl. No.: 11/811,068

(22) Filed: Jun. 8, 2007

(65) Prior Publication Data

US 2008/0301854 A1 Dec. 11, 2008

(51) Int. Cl.
*A42C 5/04* (2006.01)

(52) U.S. Cl. ..... 2/181.4; 2/181

(58) Field of Classification Search ..... 2/181, 181.4, 2/209.13, 171, 175.1
See application file for complete search history.

(56) References Cited

U.S. PATENT DOCUMENTS 2,411,831 A 11/1946 Lehmberg et al.
4,630,317 A * 12/1986 Brown et al. ..... 2/12
5,025,504 A * 6/1991 Benston et al. ..... 2/181.4
5,033,122 A 7/1991 Smith
5,088,126 A 2/1992 Mathis
5,313,668 A * 5/1994 Bogan et al. ..... 2/181.4
5,317,761 A * 6/1994 Piche ..... 2/181
5,553,326 A * 9/1996 Moore ..... 2/181
5,915,534 A * 6/1999 May ..... 2/181.4
5,920,910 A * 7/1999 Calvo ..... 2/181.4
5,978,969 A 11/1999 Vinding Diers
6,477,715 B2 * 11/2002 Shin ..... 2/181.4
6,571,396 B1 * 6/2003 Yan ..... 2/195.1
6,738,985 B2 * 5/2004 Hahn et al. ..... 2/181
7,174,572 B1 * 2/2007 Diamond et al. ..... 2/181
2002/0100107 A1 * 8/2002 Shin ..... 2/181
2003/0213049 A1 * 11/2003 Hahn et al. ..... 2/181.4
2005/0193470 A1 9/2005 Nalls
2006/0123526 A1 * 6/2006 Lim ..... 2/181

* cited by examiner

*Primary Examiner* — Katherine Moran
*Assistant Examiner* — Richale L Quinn
(74) *Attorney, Agent, or Firm* — John Alumit; Patel & Alumit, PC

(57) ABSTRACT

A system for placing a disposable sweatband on a variety of hats comprises the steps of attaching an adhesive tape with a backing paper to at least one longitudinal edge of the sweatband, for affixing to the hat in use. The adhesive tape can also be formed as an inner flap of the sweatband.

1 Claim, 8 Drawing Sheets

SYSTEM FOR PLACING DISPOSABLE SWEATBAND

CROSS-REFERENCE TO RELATED APPLICATION

None

FEDERALLY SPONSORED RESEARCH

Not Applicable

SEQUENCE LISTING OR PROGRAM

Not Applicable

STATEMENT REGARDING COPYRIGHTED MATERIAL

Portions of the disclosure of this patent document contain material that is subject to copyright protection. The copyright owner has no objection to the facsimile reproduction by anyone of the patent document or the patent disclosure as it appears in the Patent and Trademark Office file or records, but otherwise reserves all copyright rights whatsoever.

BACKGROUND

The present invention relates in general to sweatband, and more particularly to a system for placing a disposable sweatband on a hat. The sweatband can be used along with any variety of hats.

Several disposable sweatbands have been developed in art. For example, U.S. Pat. No. 5,033,122 to Smith discloses a disposable and short-term bio-degradable sweatband suitable for collecting and controlling perspiration. The band is completely formed by an arrangement of laminations. The absorbent pad is extra long, allowing it to completely encircle the forehead and form a double pad over the area of heaviest sweat. The absorbent surface is always in direct contact with the sweat area. The band uses no elastic tensioning fasteners but it is adjustable as to head size and band tension. The sweatband can be folded into a small self-contained pocket pack with a pull tab for easy opening. However, the mechanism of affixing the band around the forehead is different from the present invention.

U.S. Pat. No. 5,088,126 to Mathis discloses a disposable liner to be placed inside a hard hat, or similar protective head covering, so as to be in direct contact with a wearer's forehead. The liner is formed of an absorbent material such as terry cloth which has a pressure sensitive adhesive on one side thereof. The adhesive removably secures the liner to the normal forehead contacting flap of the hard hat. The liner absorbs sweat, cushions from minor protrusions, and insulates from cold temperatures.

U.S. Pat. No. 6,738,985 to Hahn discloses a disposable sweatband liner made of a thin, flat and moisture absorbing material is shaped curved to fit around the forehead of a person. A disposable sweatband liner is affixable to a cap, hat or sun visor by adhesive material. A disposable moisture absorbing sweatband strip is shaped to fit the forehead side headband of a cap, hat or sun visor. The disposable sweatband liner is folded in half where a slit is notched for easy peel off of a peel off backing paper. The disposable sweatband liner can be affixed and detached easily by a user as needed. However, the structure of the band in both the above inventions differs from the present invention.

It is an object of the present invention to provide a sweatband without the need of sewing it onto the hat, prolonging the life of the hat.

A further object is to provide a sweatband which can easily be replaced and disposed.

Finally, it is an object of the present invention to provide sweatbands of different sizes. These and other objects of the present invention will become better understood with reference to the appended Summary, Description, and Claims.

SUMMARY

The present invention is a system for placing a disposable sweatband on a hat. The sweatbands generally comprise a layer made of felt material and an inner flap running longitudinally along one of the edges of the layer. The system of the present invention comprises a step of attaching a tape with backing paper to the inner flap. The tape can also be formed as an inner flap of the sweatband. The adhesive on the tape facilitates the band to be removably stuck to the inside of the hat in use.

FIGURES—REFERENCE NUMERALS

Figure 1:
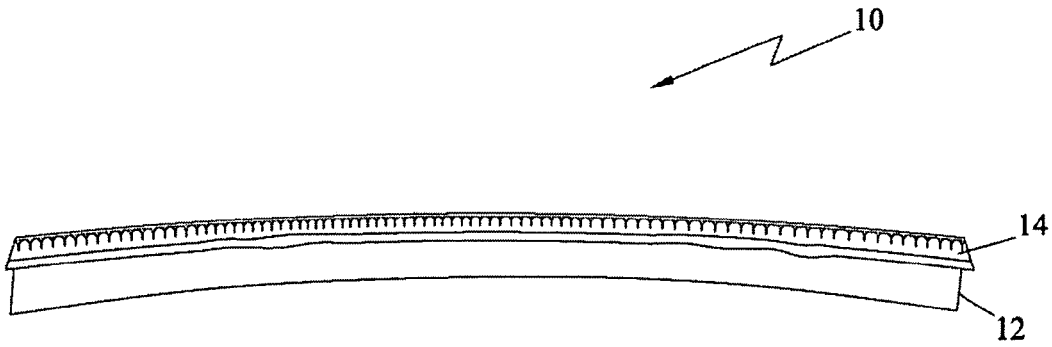
FIG. 1 is a perspective view of a disposable sweatband in accordance with the present invention.
Figure 2:
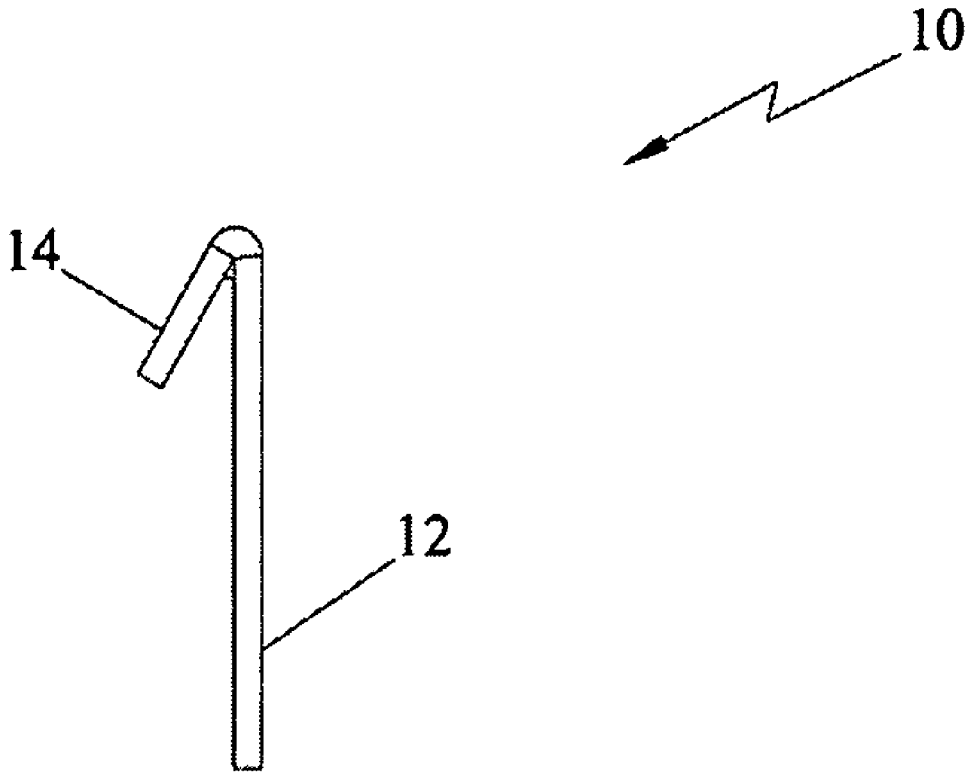
FIG. 2 is a side view of the disposable sweatband in accordance with the present invention.
Figure 3:
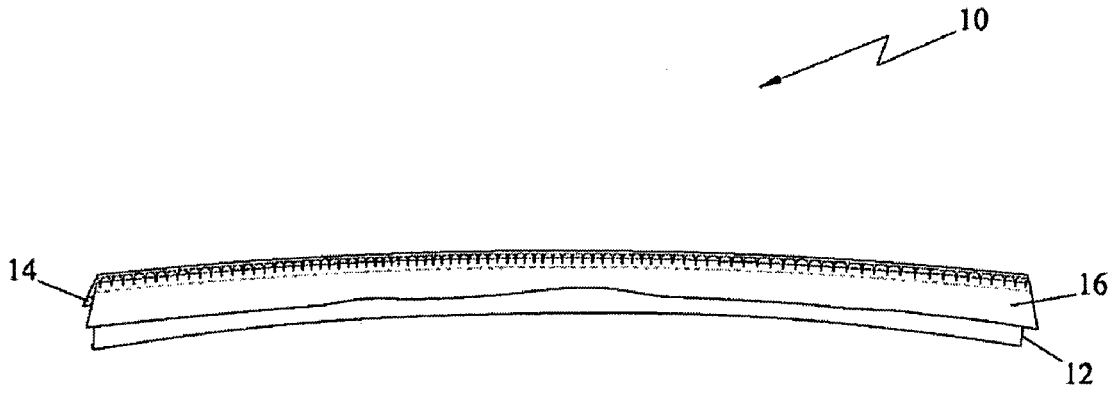
FIG. 3 is a perspective view of a sweatband with sewed tape with backing paper.
Figure 4:
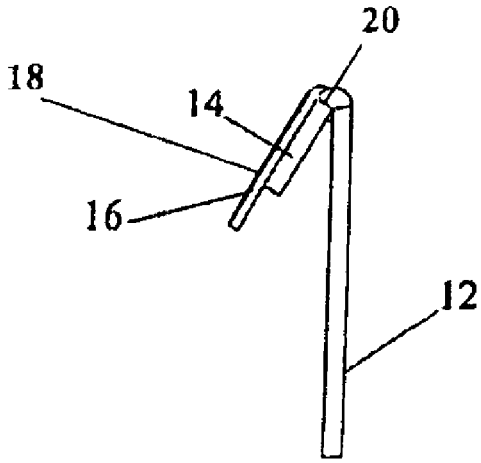
FIG. 4 is a side view of the sweatband with sewed tape with backing paper.
Figure 5:
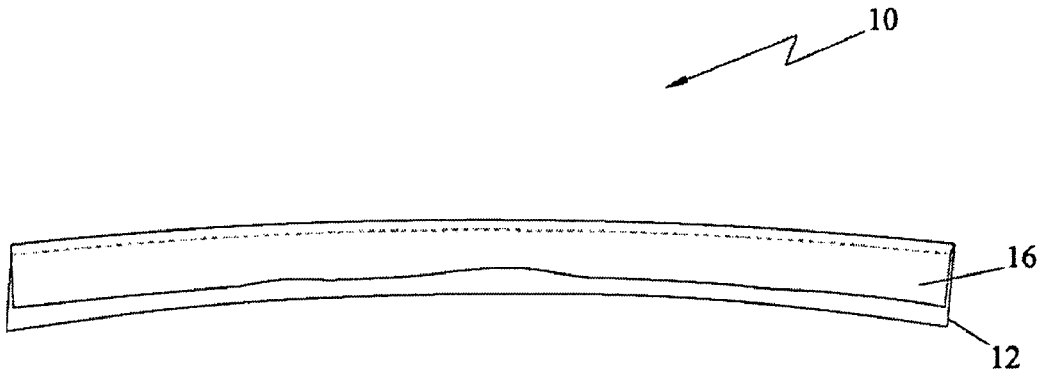
FIG. 5 is a perspective view of a sweatband with a tape extending from a layer of felt material.
Figure 6:
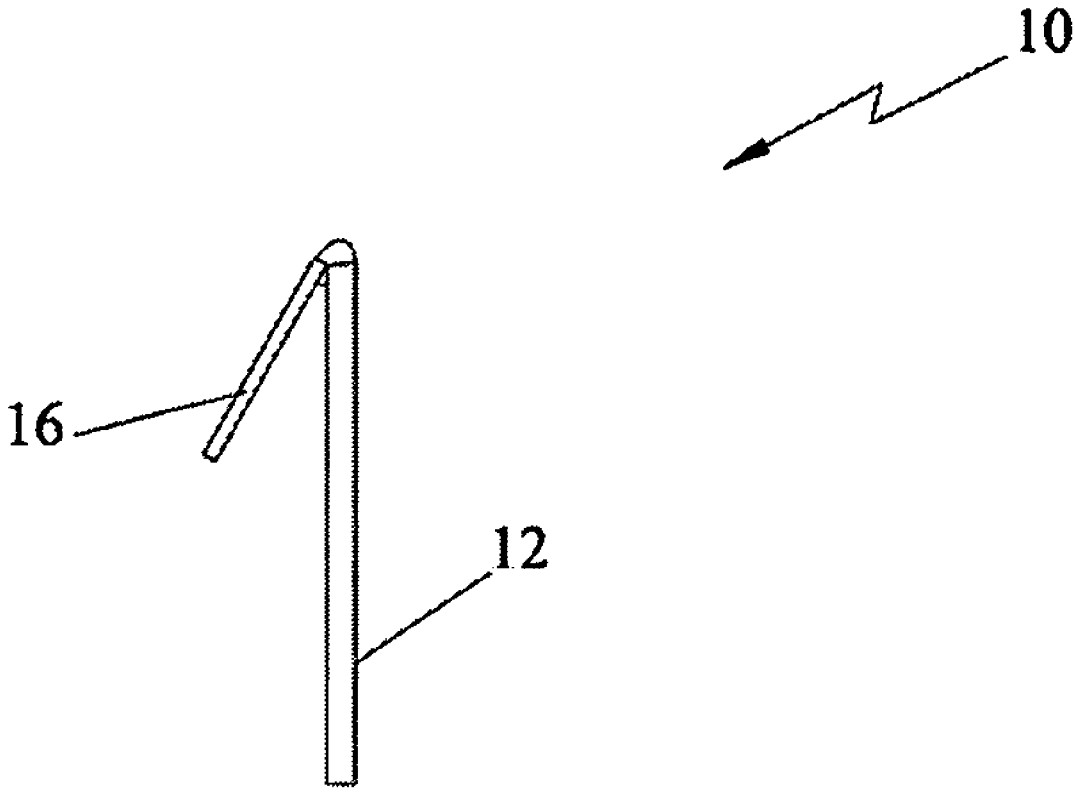
FIG. 6 is a side view of the sweatband with a tape extending from a layer of felt material.

10 . . . Sweatband
12 . . . Layer of Felt Material
14 . . . Inner Flap
16 . . . Tape
18 . . . Backing paper
20 . . . Stitching

DETAILED DESCRIPTION

Referring to the drawings, a preferred embodiment of a system of placing a disposable sweatband on a hat is illustrated and generally indicated as 10 in FIGS. 1 through 8. The sweatbands 10 of the present invention need not be sewed onto the hat and can be used along with hats of varied.

Referring to FIGS. 1 through 6, a sweatband generally comprises a layer made of felt material 12 and an inner flap 14 running longitudinally along one of the edges of the layer 12. The inner flap 14 is narrow in width and is secured along one of the longitudinal edges of the layer 12. The system of the present invention comprises a step of attaching a tape 16 with a backing paper to the inner flap 14. The tape 16 is narrower in width than the layer of felt material 12. One of the longitudinal edges of the tape 16 is attached to the longitudinal edge of the layer made of felt material 12 and the other longitudinal edge of the tape 16 is left free.

Referring to FIGS. 1 through 6, the tape 16 has a backing paper 18 covering the adhesive on one surface of the tape 16. The removal of the backing paper 18 exposes the adhesive, facilitating the attachment of the band to the inside of the hat of use. In one embodiment the longitudinal edge of the tape 16 is sewed 20 to the inner flap 14. In another embodiment the tape 16 is designed as the inner flap 14 of the sweatband 10.

Figure 7:
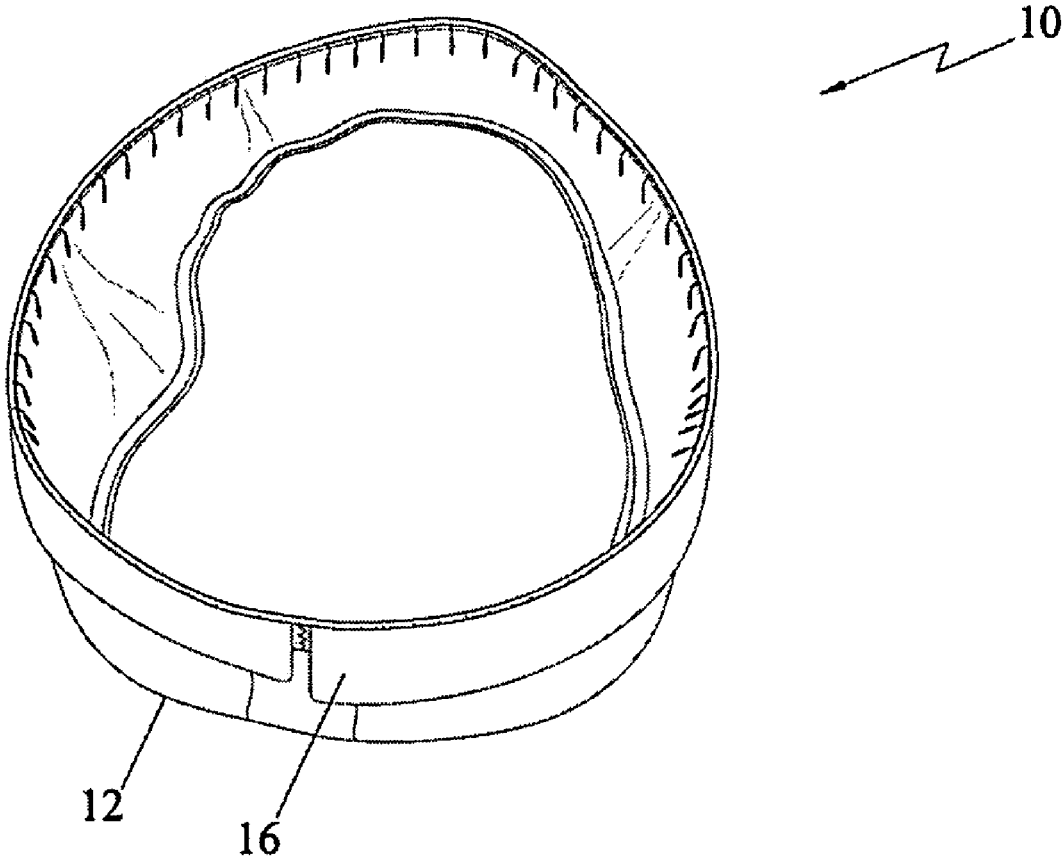
FIG. 7 is a perspective view of a curved sweatband.
Figure 8:
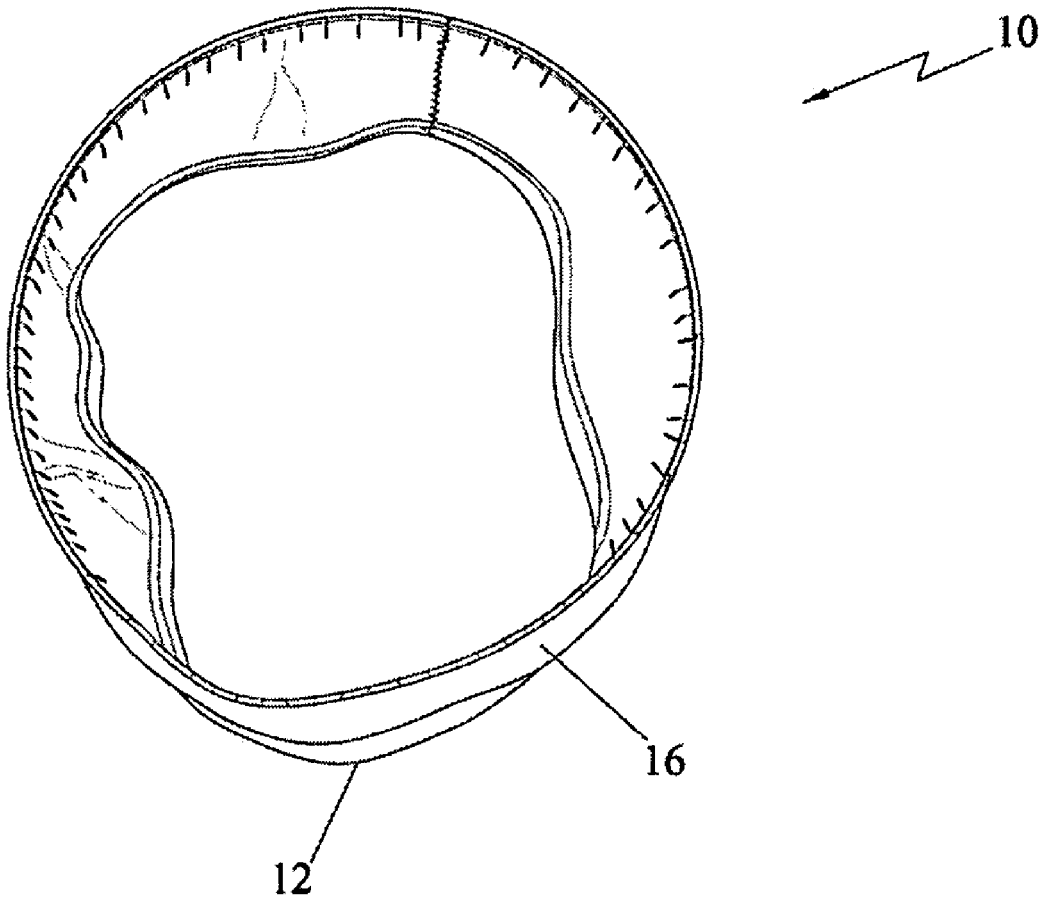
FIG. 8 is a top view of a curved sweatband.

Referring to FIGS. 7 and 8, the sweatband 10 is a flat rectangular elongated slip that can be curved to encircle the entire forehead. The layer of felt material 12 is placed in contact with forehead of the user facilitating the absorption of perspiration. The band can be removed with ease from the hat when needed and replaced with a new one.

All features disclosed in this specification, including any accompanying claims, abstract, and drawings, may be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means for" performing a specified function, or "step for" performing a specific function, is not to be interpreted as a "means" or "step" clause as specified in 35 U.S.C. §112, paragraph 6. In particular, the use of "step of" in the claims herein is not intended to invoke the provisions of 35 U.S.C. §112, paragraph 6.

Although preferred embodiments of the present invention have been shown and described, various modifications and substitutions may be made thereto without departing from the spirit and scope of the invention. Accordingly, it is to be understood that the present invention has been described by way of illustration and not limitation.

What is claimed is:

1. A disposable sweatband system for a variety of hats comprising:

a layer of felt material;

an inner flap running longitudinally alone one of the edges of the layer of felt material, wherein the inner flap is narrower in width than the layer of felt material, and a tape that is narrower in width than the layer of felt material, and that has adhesive on one side that is covered with backing paper, wherein the tape is attached to the inner flap on the side of the tape without the backing paper, and wherein the backing paper on the other side can be removed to expose the adhesive, thereby facilitating the attachment of the layer of felt material to the inside of a hat.

* * * * *